United States Patent [19]

Kurematsu et al.

[11] Patent Number: 4,859,575

[45] Date of Patent: Aug. 22, 1989

[54] METHOD FOR PROCESSING OF SILVER HALIDE COLOR PHOTOGRAPHIC MATERIAL WITH DIALYSIS TREATMENT

[75] Inventors: Masayuki Kurematsu; Shigeharu Koboshi, both of Hino, Japan

[73] Assignee: Konishiroku Photo Industry Co., Ltd., Tokyo, Japan

[21] Appl. No.: 236,321

[22] Filed: Aug. 24, 1988

Related U.S. Application Data

[63] Continuation of Ser. No. 117,884, Oct. 23, 1987, abandoned, which is a continuation of Ser. No. 931,915, Nov. 17, 1986, abandoned, which is a continuation-in-part of Ser. No. 731,085, May 6, 1985, abandoned.

[30] Foreign Application Priority Data

May 16, 1984 [JP] Japan ..... 59-96352

[51] Int. Cl.[4] ..... G03C 7/00; G03C 5/24; G03C 7/40

[52] U.S. Cl. ..... 430/428; 204/182.4; 430/372; 430/398; 430/399

[58] Field of Search ..... 430/372, 398, 399, 428; 204/182.4

[56] References Cited

U.S. PATENT DOCUMENTS

| | | | |
|---|---|---|---|
| 4,207,157 | 6/1980 | Hirai et al. | 204/182.4 |
| 4,311,574 | 1/1982 | Ishikawa | 204/182.4 |
| 4,313,808 | 2/1982 | Idemoto et al. | 204/182.4 |
| 4,336,324 | 6/1982 | Koboshi et al. | 430/372 |
| 4,537,856 | 8/1985 | Kurematsu et al. | 430/372 |
| 4,749,642 | 6/1988 | Kurematsu et al. | 430/428 |
| 4,752,556 | 6/1988 | Kishimoto | 430/398 |
| 4,774,169 | 9/1988 | Kuse et al. | 430/467 |
| 4,778,743 | 10/1988 | Ishikawa et al. | 430/428 |
| 4,778,748 | 10/1988 | Kuse et al. | 430/428 |
| 4,786,584 | 11/1988 | Endo | 430/399 |

*Primary Examiner*—Mukund J. Shah

*Attorney, Agent, or Firm*—Frishauf, Holtz, Goodman & Woodward

[57] ABSTRACT

Disclosed is a method for processing of a photographic material which comprises carrying out stabilizing processing of a photographic material with a stabilizing solution substantially without washing with water subsequent to the processing with a processing having fixing ability, wherein said stabilizing solution is subjected to electrodialysis treatment.

20 Claims, 1 Drawing Sheet

METHOD FOR PROCESSING OF SILVER HALIDE COLOR PHOTOGRAPHIC MATERIAL WITH DIALYSIS TREATMENT

This application is a continuation of application Ser. No. 07/117,884, filed Oct. 23, 1987, which is a continuation of Ser. No. 931,915 filed Nov. 17, 1986 (abandoned), which is a CIP of Ser. No. 731,085 filed may 6, 1985 (abandoned).

BACKGROUND OF THE INVENTION

This invention relates to a method for processing of a silver halide color photographic material (hereinafter abbreviated as photographic material), particularly to a method for stabilizing processing substantially without carrying out the step of washing with water subsequent to the desilverization step.

In recent years, in a photo-finisher which carries out developing processing of photographic materials automatically and continuously, the problems of protection of environment and water resources are regarded as important, and it is desired to reduce the large amount of washing water employed in the water washing step which is carried out after fixing or bleach-fixing processing preferably to zero. For this purpose, there have been proposed techniques to carry out stabilizing processing directly after fixing or bleach-fixing processing without performing washing with water. For example, Japanese Laid-open Pat. Publications Nos. 8542/1982, 132146/1982, 14834/1982 and 18631/1983 disclose techniques for processing with liquid stabilizer containing isothiazoline derivatives, benzisothiazoline derivatives, soluble iron complexes, polycarboxylic acids, organic phosphonic acids.

These techniques concern methods for inhibiting or preventing the problems caused by the fixing or bleach-fixing components brought into the liquid stabilizer by the photographic material. None of these techniques are practically useful at when more than a specified of the fixing and bleach-fixing component is brought into the liquid stabilizer. The replenishing amount of liquid stabilizer is required to be used in a specified minimum amount. Particularly, there is involved the drawback that yellow stain at the unexposed portion in the photographic material is increased due to the prolonged storage after processing.

Also, as another problem, when stabilizing processing without washing with water is conducted continuously for a long term, stain immediately after processing at the unexposed portion is found to be increased disadvantageously, irrespectively of the amount of the fixing and bleach-fixing components entrained into the liquid stabilizer.

SUMMARY OF THE INVENTION

Accordingly, a first object of the present invention is to provide a method for processing colors stably without problem by reducing the concentrations of fixing and bleach-fixing components in the stabilizing solution.

A second object of the present invention is to provide a method for color stabilizing processing of a photographic material without increase in stain at the unexposed portion immediately after processing even when continuous processing may be performed for a long term.

A third object of the present invention is to reduce the amount of the replenishing stabilizing solution by removing the harmful components in the stabilizing solution, thereby enabling reuse of the stabilizing solution.

A further object of the invention is to remove Fe(III) ions from the stabilizing solution.

The method for processing of a photographic material in the present invention comprises carrying out stabilizing processing of a photographic material with a stabilizing solution substantially without washing with water subsequent to the processing with a processing having fixing ability, wherein said stabilizing solution is subjected to electrodialysis treatment.

According to a preferred embodiment of the present invention, the stabilizer solution contains a chelating agent having a chelate stability constant with iron (III) ions of 6 or more.

DESCRIPTION OF PREFERRED EMBODIMENTS

Figure 1:
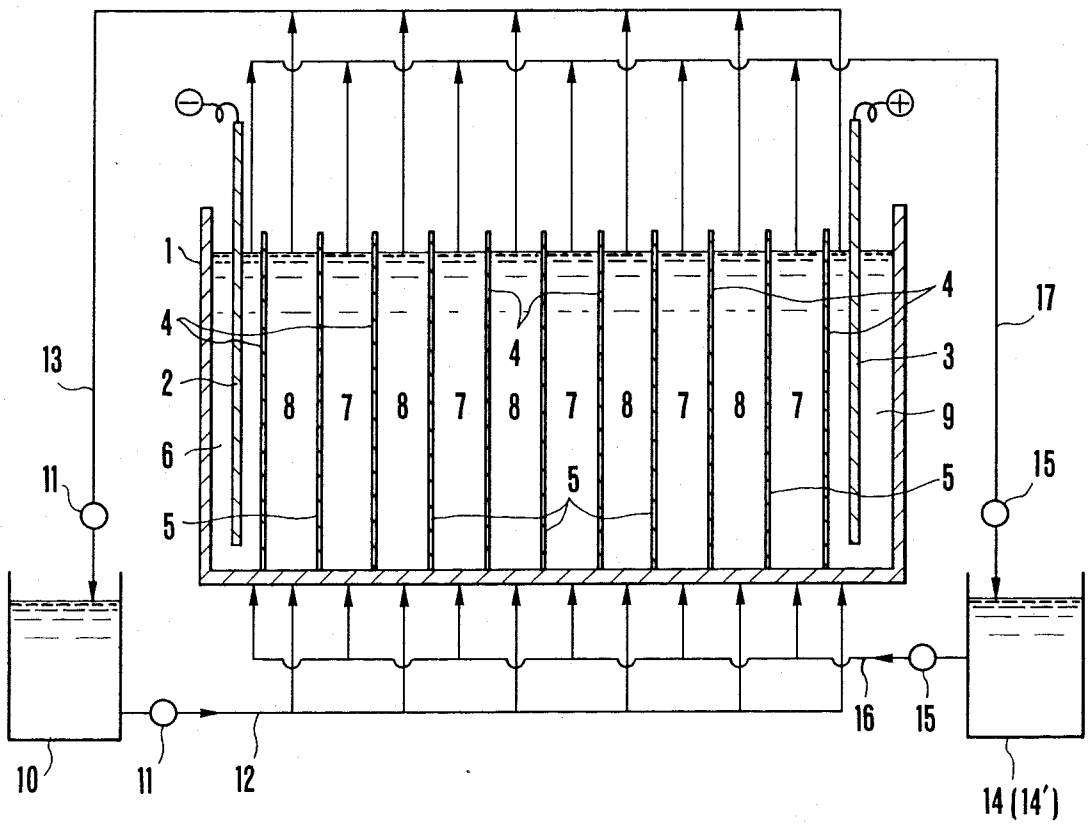
FIG. 1 is a schematic illustration of an example of the treating method of the present invention employing an electrodialytic device.

The present invention will be described in more detail hereinafter.

All of the materials washed away in the step of washing with water in conventional processing having the step of washing with water, such as fixing and bleach-fixing materials and fatigued components, are accumulated in the liquid stabilizer when stabilizing processing is performed directly without carrying out the step of washing with water, whereby yellow stain in prolonged storage of photographic materials and stain immediately after processing will be generated.

The present inventors, as the result of intensive researches, has discovered that generation of stain can be prevented by treating a liquid stabilizer in electrodialysis and removing Fe(III) ions by said electrodialysis. The electrodialysis treatment of the present invention is carried out by placing a liquid stabilizer into compartments partitioned with a diaphragm membrane between the cathode and the anode of an electrodialysis cell and passing direct current between the electrodes.

Preferably the diaphragm membrane may be an ion-exchange membrane. More preferably, the cell should be partitioned by anion exchange membranes and cation exchange membranes alternately between the cathode and the anode to consist of a cathode chamber, a plurality of concentration chambers (chamber partitioned by an anion exchange membrane on the cathode side and a cation exchange membrane on the anode side), a plurality of desalination chambers (chamber partitioned by a cation exchange membrane on the cathode side and an anion exchange membrane on the anode side) and an anode chamber. The liquid stabilizer should preferably be introduced into the desalination chambers and also preferably into the cathode chamber. The electrolyte solutions to be introduced into the concentration chambers and the anode chamber are not particularly limited, but may include preferably, for example, 0.1 to 2N solutions of sodium sulfite, sodium sulfate, sodium choride, potassium sulfate, sodium thiosulfate, etc. During this operation, use of a processing solution having fixing ability as the electrolyte solution to be introduced into the concentration chambers and the anode chamber is particularly preferred, since no particular use of an electrolyte solution is required. Also, silver can be recovered from the above electrolyte solution, and the electrolytic method and the ion-exchange resin method may be employed for recovery of silver.

Commercially available resins may also be used as the above ion-exchange membrane. For example, such resins are known under the trade names of Aciplex, produced by Asahi Kasei Kogyo K.K., Selemion, produced by Asahi Glass K.K., NEOSEPTA, produced by Tokuyama Soda K.K., Unilex, produced by Mitsubishi Yuka K.K., Nafion, produced by Du Pont Co., etc.

As the material for the electrodialytic cell and respective pipes, there may be employed polyvinyl chloride, polypropylene, polyethylene and iron or other metals lined with rubber. The material for the cathode may include iron, nickel, lead, zinc, titanium alloys, stainless steel, etc., and the material for the anode may be platinum, platinum-plated titanium, graphite, lead peroxide, magnetite, etc.

The stabilizing liquid of the present invention should preferably contain a chelating agent having a chelate stabilizing constant with iron (III) ions of 6 or more. The chelate stability constant as mentioned in the present invention is generally known as described in L. G. Sillen, A. E. Martell "Stability Constants of Metal-ion Complexes", The Chemical Society, London (1964) and S. Chaberek, A. E. Martell, "Organic Sequestering Agents", Wiley (1959). The chelating agents having a chelate stability constant with iron (III) ions of 6 or more of the present invention may include organic carboxylic acid chelating agents, organic phosphoric acid chelating agents, condensation phosphoric acid chelating agent and polyhydroxy compounds. The more preferable chelating agent to be used in the present invention may have a chelate stabilizing constant with iron (III) ions of 13 or more such as ethylenediamine diorthohydroxyphenylacetic acid, nitrilotriacetic acid, hydroxyethylenediaminetriacetic acid, diethylenetriaminepentaacetic acid, hydroxyethyliminodiacetic acid, diaminopropanoltetraacetic acid, transcyclohexanediaminetetraacetic acid, ethylenediaminetetrakismethylenephosphonic acid, nitriletrimethylenephosphonic acid, 1-hydroxyethylidene-1, 1-diphosphonic acid, 1,1'-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate, sodium hexametaphosphate, etc. For the effect of the present invention, particularly preferred are diethylenetriaminepentaacetic acid, 1-hydroxyethylidene-1,1-diphosphonic acid and salts thereof.

The compounds which can desirably be added into the stabilizing solution of the present invention may include pH controllers such as acetic acid, sulfuric acid, hydrochloric acid, nitric acid, sulfanilic acid, potassium hydroxide, sodium hydroxide, ammonium hydroxide, etc.; anti-fungus agents such as sodium benzoate, hydroxy butylbenzoate, antibiotics, dehydroacetic acid, potassium sorbate, thiabendazole, o-phenylphenol, etc.; preservatives such as 5-chloro-2-methyl-4-isothiazolin-3-one, 2-octyl-4-isothiazolin-3-one, 1,2-benzisothiazoline-3-one, water-soluble metal salts, etc.; dispersants such as ethylene glycol, polyethylene glycol, polyvinyl pyrrolidone, etc.; film hardeners such as formalin, etc.; fluorescent whitening agents; and so on.

Among these compounds, most effective are ammonia compounds as disclosed in Japanese Unexamined Pat. Publication No. 184345/1984, for example, an ammonium salt of an inorganic acid such as aqueous ammonia, ammonium bromide, ammonium carbonate, ammonium chloride, ammonium chromate, ammonium dichromate, ammonium hypophosphite, ammonium phosphate, ammonium phosphite, ammonium fluoride, acid ammonium fluoride, ammonium fluoroborate, ammonium arsenate, ammonium hydrogen-carboxylate, ammonium hydrogenfluoride, ammonium hydrogensulfate, ammonium hydrogensulfite, ammonium iodide, ammonium nitrate, ammonium pentaborate, ammonium perchlorate, ammonium peroxodisulfate, ammonium persulfate, ammonium phosphomolybdate, ammonium tungstate, ammonium silicofluoride, ammonium sulfamate, ammonium sulfate, ammonium sulfite, ammonium tetraborate, ammonium tetrafluoroborate, ammonium thiocyanate, ammonium tungstate, ammonium banadate, ammonium polyphosphate, ammonium pyrophosphate, etc.; an ammonium salt of an organic salt such as ammonium acetate, ammonium adipate, ammonium taurine tricarboxylate, ammonium benzoate, ammonium carbamate, ammonium citrate, ammonium diethyldithiocarbamate, ammonium formate, ammonium hydrogenmalate, ammonium hydrogenoxalate, ammonium hydrogenphthalate, ammonium hydrogentartarate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanilate, ammonium tartarate, ammonium thioglycolate, ammonium 2,4,6-trinitrophenol, ammonium iminodiacetate, ammonium hydroxyethyliminodiacetate, ammonium nitrilotriacetate, ammonium ethylenediaminetetraacetate, ammonium diethylenetriaminepentaacetate, ammonium hydroxyethylethylenediaminetriacetate, ammonium trans-cyclohexanediaminetetraacetate, ammonium diaminopropanoltetraacetate, ammonium nitrilotripropionate, ammonium nitrilotrismethylenephosphonate, ammonium ethylenediaminetetramethylenephosphate, ammonium 1-hydroxy-ethylidene-1, 1'-diphosphate, ammonium 2-phospho-butane-1, 2,4-tricarboxylate, ammonium di-(2-hydroxyethyl)aminomethanesulfonate, etc.; an ammonia-metal complex such as ammonium alum, ammonium ceric sulfate, ammonium manganese sulfate, ammonium ferrous sulfate (dodecahydrate), Reinecke's salt (hydrate), cuprammonia sulfate, ammonia calcium complex salt, ammonia magnesium complex salt, etc. or the like. Namely, these compounds release ammonia or ammonium ion (including hydrated ion) or ammonium hydroxide when added to the liquid stabilizer, and should not be limited to the above-mentioned specific compounds.

As mentioned above, it is preferred to incorporate anti-fungus agents in the stabilizing solution of the present invention. The anti-fungus agents to be used preferably may include hydroxy benzoic acid type compounds, alkylphenol type compounds, thiazole type compounds, pyridine type compounds, guanizine type compounds, carbamate type compounds, morpholin type compounds, quarternary phosphonium type compounds, ammonium type compounds, urea type compounds, isoxazole type compounds, propanolamine type compounds, sulfamide derivatives and amino acid type compounds.

As the above hydroxy benzoic acid type compounds, there may be mentioned hydroxy benzoic acid and esterified compounds of hydroxy benzoic acid such as methyl ester, ethyl ester, propyl ester, butyl ester, etc., preferably, butyl ester, isobutyl ester and propyl ester of hydroxy benzoic acid, more preferably a mixture of the above-mentioned three kinds of hydroxy benzoic acid esters.

As the alkylphenol type compounds, there may be mentioned compounds having, as a substituent group, an alkyl group of 1 to 6 carbon atoms preferably, o-phenol or o-cyclohexylphenol.

As the thiazole type compounds, there may be mentioned a compound having a nitrogen atom or a sulfur atom in the 5-membered ring, preferably, 1,2-benzisothiazolin-3-one, 2-methyl-4-isothiazolin-3-one, 2-octyl-4-isothiazolin-3-one, 5-chloro-2-methyl-4-isothiazolin-3-one or 2-(4-thiazolyl) benzimidazole. As the pyridine type compounds, there may specifically be mentioned 2,6-dimethylpyridine, 2,4,6-trimethylpyridine, sodium-2-pyridinethiol-1-oxide, etc., preferably, sodium-pyridinethiol-1-oxide.

As the guanidine type compounds, there may specifically be mentioned cyclohexidine, polyhexaethyleneguanidine hydrochloric acid salt, dodecylguanidine hydrochloric acid salt, preferably, dodecylguanidine and its salt.

As the carbamate type compounds, there may specifically be mentioned methyl-1-(butylcarbamoyl)-2-benzimidazolecarbamate, methyl imidazolecarbamate, etc.

The morpholin type compounds may specifically include 4-(2-nitrobutyl)morpholin, 4-(3-nitrobutyl)morpholin, etc.

As the quarternary phosphonium type compounds, there may be mentioned tetraalkylphosphonium salt, tetraalkoxyphosphonium salt, etc., preferably, tetraalkylphosphonium salt and as more preferably specific compounds, there may be mentioned tri-n-butyl-tetradecylphophonium chloride, triphenyl·nitrophenylphosphonium chloride, etc.

The quarternary ammonium compounds may specifically include benzalkonium salt, benzethonium salt, tetraalkylammonium salt and alkylpyridinium salt, more specifically, dodecyldimethylbenzylammonium chloride, didecyldimethylammonium chloride, lauryl-pyridinium chloride, etc.

The specific urea type compounds may be exemplified N-(3,4-dichlorophenyl)-N'-(4-chlorophenyl)urea, N-(3-trifluoromethyl-4-chlorophenyl) -N'-(4-chlorophenyl)urea, etc.

As the isoxazole type compounds, there may specifically be mentioned 3-hydroxy-5-methyl-isoxazole and the like.

The propanolamine type compounds may include n-propanols and isopropanols, and specifically DL-2-benzylamino-1-propanol, 3-diethylamino-1-propanol, 2-dimethylamino-2-methyl-1 -propanol, 3-amino-1-propanol, isopropanolamine, diisopropanolamine, NN-dimethyl-isopropanolamine, etc.

As the sulfamide derivatives, there may specifically be mentioned a fluorinated sulfamide, 4-chloro-3,5-dinitrobenzenesulfamide, sulfanylamide, acetosulfamine, sulfapyridine, sulfaguanidine, sulfathiazole, sulfadiazine, sulfamerazine, sulfamethazine, sulfaisooxazole, homosulfamine, sulfisomidine, sulfamethizole, sulfapyradine, phthalisosulfathiazole, succinylsulfathiazole, etc.

As the amino acid type compounds, there may specifically be mentioned N-lauryl-$\beta$-alanine.

Of the above anti-fungus agents, it is pyridine type compounds, guanidine type compounds and tetraammonium type compounds that may preferably be used in the present invention. The amount of the anti-fungus agent to be added into the liquid stabilizer is preferably within the range of 0.002 g to 50 g, more preferably within the range of of 0.005 g to 10 g per 1 liter of the liquid stabilizer.

Concerning techniques for incorporating said anti-fungus agents, the compositions and use examples, reference may be made to the descriptions in the specifications of Japanese Laid-open Patent Publications Nos. 14834/1983, 105145/1983, 134634/1983, 18631/1983 and 126533/1984.

The liquid stabilizer according to the present invention should desirably be controlled to a pH value of 0.1 to 10, preferably pH 2 to 9, more preferably pH 4 to 8.5.

The processing temperature in stabilizing processing may be 15° C. to 60° C., preferably 20° C. to 45° C. The processing time should preferably as short as possible from the standpoint of rapid processing, but it is generally 20 seconds to 10 minutes, most preferably one minute to 5 minutes. In stabilizing processing by multiple tanks, the processing should be conducted within shorter time in preceding tanks with the processing time being longer in the tanks at the later stages. Particularly, it is preferable to perform processings successively with increased time by 20% to 50% as compared with the preceding tank. Also, it is preferred to employ a counterflow system in which the stabilizing processing step consists of multi-stage tanks and the replenishing liquid is supplied from the final stage tank, from which the liquid is overflowed successively to the tanks in the preceding stages. After the stabilizing processing of the present invention, no processing of washing with water is required, but rinsing with small amount of water within a very short time or surface washing may be conducted.

The processing solution having fixing agent is intended for desilverization, which solution may be a bleach-fixing bath or a fixing bath. The fixing agent to be used may be, for example, thiosulfates, thiocyanates, iodides, bromides, thioethers and thioureas. Among them, the fixing agent generally employed is a thiosulfate.

When carrying out directly the stabilizing processing substantially without washing with water subsequent to the fixing processing of the present invention, it is also possible to provide a bath for silver recovery or rinsing within a short period of time between the bleaching bath or the bleach-fixing bath and the stabilizing processing.

The stabilizing solution used for the present invention should be brought into contact with the photographic material, preferably according to the method conventionally used for dipping a photographic material in processing liquids in general, but the liquid may be applied on both surfaces of the emulsion surface and the conveying leader of the photographic material and the conveying belt by sponge, synthetic fiber cloths, etc. or blasted thereagainst by means of a spray, etc.

In the present invention, the stabilizing solution is subjected to electrodialysis treatment. As said treatment method there may be employed the method in which the stabilizing liquid in the stabilizing bath is directly connected to the electrodialytic device to carry out treatment continuously, and the method in which the overflow discharged from the stabilizing bath is subjected to electrodialysis treatment and returned to the stabilizing bath. The former method is preferred. In practicing the electrodialysis treatment, it is preferred to circulate the solution from chamber to chamber in the respective chambers divided by the membranes in the electrolytic device. More preferably, in the case of the stabilizing bath directly connected to the device, the liquid stabilizer should be constantly circulated between the desalination chambers and the cathode chamber. On the other hand, in the case of the above treatment of the overflow, the stabilizing solution should be constantly circulated between the reservoir tank of the overflow and the desalination chambers and the cathode chamber.

The stabilizing processing in the present invention may be carried out in a stabilizing processing tank of one or two or more tanks. In the case of using two or more tanks, the electrodialytic device should preferably be connected to the stabilizing tank nearer to the processing bath having fixing ability. Also, in the case of electrodialysis treatment of overflow, the overflow from the stabilizing tank nearer to the processing tank having fixing ability should preferably be subjected to electrolysis treatment. The stabilizing liquid after treatment may be used also as the replenishing solution, but in this case it is preferred to add stabilizing components into the solution.

The replenishing amount of the stabilizing solution is preferably not more than 2 liters per 1 $m^2$ of photographic material, more preferably 20 ml to 1 liter.

Further, before and/or after electrolysis treatment of the liquid stabilizer of the present invention, it may also be treated by contact with cation exchange resins, anion exchange resins, chelate resins or adsorptive resins, or treated by reverse osmosis. Two or more of such treatment methods may also be used in combination.

When the photographic material is subjected to color forming development, prior to the treatment method of the present invention, to form a color image through the coupling reaction of the oxidized product of a color developing agent and a color coupler, or when the "processing solution having fixing ability" according to the present invention contains a fixing component but no bleaching component, the material after the above color developing processing should of course be subjected to bleaching processing. Concerning these color developing to bleaching processing, the techniques in general may be specifically unlimitedly available, and reference may also be made to the techniques developed by the present applicant, as disclosed in Japanese Laid-open Patent Publications Nos. 14834/1983, 105145/1983, 134634/1983, 18631/1983 and 126533/1984.

The present invention is described in more detail by referring to the following Examples.

EXAMPLE- 1

As the photographic material, Sakura color paper (produced by Konishiroku Photo Industry Co.) was used and the experiments were carried out with the processing liquids and the pocessing steps as shown below.

| Standard processing steps | | |
|---|---|---|
| [1] Color developing | 38° C. | 3 min. 30 sec. |
| [2] Bleach-fixing | 33° C. | 1 min. 30 sec. |
| [3] Stabilizing processing | 25° C.–30° C. | 3 min. |
| [4] Drying | 75° C.–80° C. ca. | 2 min. |

| Processing liquid composition | |
|---|---|
| (Color developing tank liquid) | |
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—ethyl-N—(β-methanesulfonamidoethyl)aniline sulfate | 5.5 g |
| Fluorescent whitening agent (4,4'-diaminostilbenzsulfonic acid derivative) | 1.0 g |
| Catechol-3,5-disulfonic acid | 0.3 g |
| (made up to one liter with addition of water and adjusted to pH 10.00 with KOH). | |
| (Color developing replenishing liquid) | |
| Benzyl alcohol | 22 ml |
| Ethylene glycol | 20 ml |
| Potassium sulfite | 3.0 g |
| Potassium carbonate | 30.0 g |
| Hydroxylamine sulfate | 4.0 g |
| Polyphosphoric acid (TPPS) | 3.0 g |
| 3-Methyl-4-amino-N—ethyl-N—(β-methanesulfonamidoethyl)aniline sulfate | 7.5 g |
| Fluorescent whitening agent (4,4'-diaminostilbenzsulfonic acid derivative) | 1.5 g |
| Catechol-3,5-disulfonic acid | 0.3 g |
| (made up to one liter with addition of water and adjusted to pH 10.50 with KOH). | |
| (Bleach-fixing tank liquid) | |
| Ferric ammonium ethylenediaminetetra-acetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| (adjusted to pH 7.1 with potassium carbonate or glacial acetic acid and made up to one liter with addition of water). | |
| (Bleach-fixing replenishing liquid A) | |
| Ferric ammonium ethylenediaminetetra-acetate dihydrate | 260 g |
| Potassium carbonate | 42 g |
| (made up to one liter with addition of water, pH of this solution is 6.7 ± 0.1). | |
| (Bleach-fixing replenishing liquid B) | |
| Ammonium thiosulfate (70% solution) | 500 ml |
| Ammonium sulfite (40% solution) | 150 ml |
| Ethylenediaminetetraacetic acid | 17 g |
| Glacial acetic acid | 85 ml |
| (made up to one liter with addition of water, pH of this solution is 4.6 ± 0.1). | |
| (Stabilizing tank liquid and replenishing liquid) | |
| 1-Hydroxeyethylidene-1,-diphosphonic acid | 2.0 g |
| 5-Chloro-2-methyl-4-isothizoline-3-one | 0.03 g |
| 2-Methyl-4-isothiazoline-3-one | 0.03 g |
| (made up to one liter with water and adjusted to pH 4.0). | |

EXPERIMENT-1

An automatic developing machine was filled with the above color developing tank liquid, bleach-fixing tank liquid and stabilizing tank liquid, and while processing a color paper subjected to imagewize exposure, the above color developing replenishing liquid, bleach-fixing replenishing liquids A and B and stabilizing replenishing liquid were supplied through quantitating cups at intervals of 3 minutes to carry out continuous processing. The amounts replenished per 1 $m^2$ of color paper were 170 ml for the color developing tank, each 25 ml of bleach-fixing replenishing liquids A and B for the bleach-fixing tank and the three points of 100 ml, 300 ml and 1 liter for the stabilizing processing tank.

The stabilizing processing tanks in the automatic developing machine consisted of stabilizing tanks of the first to the third tank in the direction of the flowing of photographic material, replenishment being performed from the final tank according to the multi-stage counter-current system wherein the overflow from the final tank was permitted to flow into the tank in its preceding stage and the overflow from this stage was further permitted to flow into its preceding stage.

Continuous processing was performed until the total amount of the stabilizing solution replenished became 3-fold of the stabilizing tank volume, and samples were obtained by processing of unexposed color paper. For comparative purpose, samples were also prepared by changing the stabilizing processing to washing with running water.

For measurement of yellow stain on instant day on said samples, reflectances at 445 nm were measured to obtain the results as shown in Table 1, and further for measurement of yellow stain with lapse of time, the samples were stored at 70° C. and 80% RH for 25 days and then subjected to measurement of yellow stain with blue light by means of an optical densitometer (PDA-65, produced by Konishiroku Photo Industry Co.) to obtain the results as shown in Table 1.

EXPERIMENT - 2

In Experiment -2, the electrolytic device body 1 was connected directly to the first tank 14 of the stabilizing processing tanks, as shown in FIG. 1, and 0.2N sodium sulfate was employed as the electrolyte solution, titanium alloy for the cathode and graphite for the anode, respectively. While carrying out the electrodialysis treatment (and Fe(III) ions removed) under these conditions, the same experiment as Experiment - 1 was conducted, and yellow stain was determined to obtain the result as shown in Table 1.

In FIG. 1, 2 shows a cathode, 3 an anode, 4 an anion exchange membrane, 5 a cation exchange membrane, 6 a cathode chamber, 7 a desalination chamber, 8 a concentration chamber, 9 an anode chamber, 10 a tank for circulation of electrolyte solution, 11 a circulation pump, 12 a pipeline or circulation of electrolyte solution (feeding side), 13 the same circulation pipeline (outflow side) 15 a circulation pump, 16 a pipeline for circulating stabilizing solution (feeding side), and 17 the same circulation pipeline (outflow side), respectively.

EXPERIMENT- 3

In Experiment 3, the electrodialytic device body 1 connected directly to the first tank 14 of the stabilizing processing tanks was changed to be connected to the third tank 14', following otherwise the same conditions as in Experiment - 2, and yellow stain was determined to obtain the result as shown in Table 1.

TABLE 1

| | Yellow stain on instant day Reflectance (%)*1 445 nm | | | Yellow stain after storage optical density (blue light) | | |
|---|---|---|---|---|---|---|
| | Replenishing amount (per 1 $m^2$) | | | | | |
| | 1 lit. | 300 ml | 100 ml | 1 lit. | 300 ml | 100 ml |
| Control | | | | | | |
| Experiment 1 | | | | | | |
| Washing with running water | (10 liters or more per 1 $m^2$) | | 82 | (10 liters or more | | |

TABLE 1-continued

| | Yellow stain on instant day Reflectance (%)*1 445 nm | | | Yellow stain after storage optical density (blue light) | | |
|---|---|---|---|---|---|---|
| | Replenishing amount (per 1 $m^2$) | | | | | |
| | 1 lit. | 300 ml | 100 ml | 1 lit. | 300 ml | 100 ml |
| | | | | per 1 $m^2$) | | 0.32 |
| Stabilizing solution | 78 | 76 | 72 | 0.32 | 0.36 | 0.44 |
| Present invention | | | | | | |
| Experiment 2 | | | | | | |
| Electrodialysis (the first tank) | 82 | 82 | 82 | 0.27 | 0.28 | 0.28 |
| Experiment 3 | | | | | | |
| Electrodialysis (the third tank) | 81 | 80 | 78 | 0.29 | 0.30 | 0.30 |

*1When the reflectance is higher, the yellow stain on instant day becomes white. On the contrary, when the reflectance is lower, the yellow stain becomes great.

As apparently seen from Table 1, by use of the-liquid stabilizing solution of the prior art, yellow stain on the instant day is higher than by washing with water, and yellow stain is greater as the replenishing amount is smaller. As to yellow stain after storage, although it is lower as compared with washing with water when the replenishing amount is one liter per 1 $m^2$, yellow stain is increased when the replenishing amount is further reduced. Accordingly, it cannot practically be used for the purpose of reducing the amount of water used to a great extent and reducing the amount of waste liquid.

Whereas, in the present invention according to Experiments 2 and 3, wherein stabilizing solutions used therein were subjected to electrodialysis treatment to remove Fe(III) ions, it can be understood that yellow stain was small on the instant day and yellow stain after storage is also considerably suppressed, thus indicating very effective results.

It can also be seen that the Experiment - 2, in which electrodialysis treatment was performed in the first tank nearer to the bath having fixing ability, is very effective as compared with Experiment - 3.

Thus, the present invention can be appreciated as very effective without any problem, even if the replenishing amount of stabilizing solution may be reduced.

EXAMPLE - 2

<Stabilizing tank solution and stabilizing supplemental solution>

| | |
|---|---|
| 1-Hydroxyethylidene-1,1-diphosphonic acid | 0.5 g |
| Bismuth chloride (45% aqueous solution) | 0.1 g |
| Magnesium sulfate | 0.04 g |
| Ammonia water (25% aqueous solution) | 2.0 g |
| 5-Chloro-2-methyl-4-isothiazolin-3-one | 0.02 g |
| 2-Methyl-4-isothiazolin-3-one | 0.02 g |
| 2-Octyl-4-isothiazolin-3-one | 0.01 g |
| o-Phenylphenol sodium salt | 0.03 g |
| (made up to one liter with water and adjusted to pH 7.0 with sulfuric acid) | |

EXPERIMENT - 4

The stabilizing tank liquid and the replenishing liquid in Experiment - 1 were replaced with the above stabilizing solution, and continuous treatment was performed in the same manner as in Experiment - 1, with the amount of the stabilizing solution replenished being 750 ml per $m^2$ of the color paper, and the treatment was changed in the way to continuous treatment by the regeneration system in which the overflow is employed as the solution for dissolving the replenishing stabilizing solution. Following otherwise the same conditions as in Experiment - 1, yellow stain was determined to obtain the result as shown in Table 2.

EXPERIMENT - 5

In the treatment by use of the electrodialytic devices of Experiments - 2 and 3 in Example - 1, continuous treatment accroding to the regeneration system was performed, in which a tank was provided in place of the stabilizing processing tank, electrodialysis treatment is conducted with the tank being filled with the liquid stabilizer overflow and the stabilizing solution after treatment is used as the liquid for dissolving the replenishing liquid, and yellow stain was determined to obtain the result as shown in Table - 2.

TABLE 2

| | Experiment - 4 (Control) | Experiment - 5 (Present invention) |
|---|---|---|
| Yellow stain on the instant day (Reflectance (%) at $\lambda$ = 445 nm) | 60 | 78 |
| Stored yellow stain; Optical density (Blue light) | 0.55 | 0.28 |

As apparently seen from Table - 2, in the Experiment - 4 (Control) in which regeneration was performed, the yellow stain on the instant day and the yellow stain on storage are unpractically higher, while the Experiment - 5 subjected to electrodialysis (Present invention) is very good in both the yellow stain on the instant day and the yellow stain on storage, thus indicating possibility of re-use.

EXAMPLE - 3

By using the same processing liquids, processing steps and processing methods as in Example - 1, except for replacing the stabilizing processing bath with two tanks, the stabilizing solution recipes of No. 6–12 as shown in Table 3 were employed.

The electrodialytic cell as shown in FIG. 1 was connected directly to the first tank similarly as in Experiment - 2 in Example - 1, and continuous treatment was performed until the total amount of the replenishing stabilizing solution became 3-fold of the stabilizing bath tank volume to effect processing of unexposed color paper. The samples were subjected to the same experiments as in Experiment- 1 in Example - 1 for determination of yellow stain to obtain the results as shown in Table - 3.

The amount of the replenishing stabilizing solution was made 100 ml per $m^2$ of the photographic material, and the same experiment according to the stabilizing solution recipe of No. 13 in Table - 3 was conducted without performing electrolysis treatment for comparative purpose to obtain the result as shown in Table - 3.

TABLE 3

| | Sample No. | Stabilizing tank solution and replenishing liquid (made up to 1 liter with water and adjusted to pH 6.0 with KOH and $H_2SO_4$) | | Yellow stain on instant day Reflectance (%) 445 nm | Yellow stain after storage optical denstiy (blue light) |
|---|---|---|---|---|---|
| Present invention | 6 | Anit-fungus agent (o-phenylphenol) | 0.1 g | 78 | 0.35 |
| | | Anti-fungus agent | 0.1 g | 82 | 0.25 |
| | 7 | 1-Hydroxyethyliden-1,1-diphosphonic acid | 5 g | | |
| | | Anti-fungus agent | 0.1 g | | |
| | 8 | Nitrilotrimethylene-phosphonic acid | 5 g | 80 | 0.29 |
| | | Anti-fungus agent | 0.1 g | | |
| | 9 | Hydroxyethylenediamine-triacetic acid | 5 g | 80 | 0.29 |
| | 10 | Anti-fungus agent | 0.1 g | | |
| | | Glycine | 5 g | 77 | 0.33 |
| | | Anti-fungus agent | 0.1 g | | |
| | 11 | Nitrilotrimethylene-phosphonic acid | 5 g | 82 | 0.23 |
| | | Ammonia water (25%) | 5 g | | |
| | | Anti-fungus agent | 0.1 g | | |
| | 12 | 1-Hydroxyethylidene-1,1-diphosphonic acid | 5 g | 82 | 0.19 |
| | | Ammonia water | 5 g | | |
| | | $MgSO_4$ | 1 g | | |
| Control | | Anti-fungus agent | 0.1 g | | |
| | 13 | 1-Hydroxyethylidene-1,1-diphosphonic acid | 5 g | 72 | 0.45 |

As apparently seen from Table 3, as compared with the results of No. 13 for comparative purpose employing no electrodialysis treatment, in the case of No. 6 to No. 12 according to the present invention wherein the stabilizing solution were subjected to the electrodialysis treatment and Fe(III) ions removal, the found to be preferable with high reflectance at 445 nm on the instant day, with yellow stain after storage at lapse of time being scarcely generated, thus exhibiting very effective results of the invention.

Also, the effect of the present invention is preferably exhibited in samples No. 7–No. 12 in which chelating agents are added into the stabilizing solution to be used in the present invention. Among them, it can be seen that the chelating agents employed in No. 7, 8, 9 are more preferable, and 1-hydroxyethylidene-1,1-diphosphonic acid employed in No. 7 is the most preferred. Further, it can also be seen that No. 11, 12 employing a combintion of a chelating agent with an ammonia water are more preferable, particularly the combination of ammonia waterwith 1-hydroxyethylidene-1,1-diphosphonic acid.

When electrodialysis was performed with the electrodialytic device body 1 connected directly to the bleach-fixing tank, for the purpose of using the bleach-fixing tank liquid in place of the electrolyte solution in FIG. 1, there was substantially no difference in the effect of the present invention, and the bleach-fixing liquid was found to be competent enough to increase the color restoration speed of the color paper, giving very excellent result without issuance of waste liquid of the electrolyte solution.

We claim:

1. In a method for processing of a photographic material which comprises carrying out stabilizing processing of a photographic material which comprises carrying out stabilizing processing of a photographic material with a stabilizing solution in a stabilizing bath substantially without washing with water subsequent to the processing with exposure, development and processing having fixing ability, the improvement comprising removing iron (III) ions form said stabilizing solution by subjecting said stabilizing solution to electrodialysis treatment; and thereafter recycling said stabilizing solution for stabilizing processing of photographic material whereby the occurrence of yellow stain in the processed photographic material using the recycled stabilizing solution is inhibited.

2. The method for processing of a photographic material according to claim 1, wherein the stabilizing solution contains a chelating agent having a chelate stability constant with iron (III) ions of 6 or more.

3. The method for processing of a photographic material according to claim 2, wherein the stabilizing solution contains a chelating agent having a chelate stability constant with iron (III) ions of 13 or more.

4. The method for processing of a photographic material according to claim 3, wherein the stabilizing solution contains a chelating agent selected from diethylenetriaminepentaacetic acid, 1-hydroxyethylidene-1,1-diphosphonic acid and salts thereof.

5. The method for processing of a photographic material according to claim 1, wherein the stabilizing solution subjected to electrodialysis by an electrodialytic cell having ion-exchange membranes which partition the cell between the cathode and the electrode.

6. The method for processing of a photographic material according to claim 5, wherein the stabilizing solution subjected to electrodialysis by an electrodialytic cell having anion exchange membranes and cation exchange membranes which partition alternately the cell between the cathode and the anode to consist of a cathode chamber, a plurality of concentration chambers, a plurality of desalination chambers and an anode chamber.

7. The method for processing of a photographic material according to claim 6, wherein the stabilizing solution is added to the desalination chambers or the cathode chamber.

8. The method for processing of a photographic material according to claim 6, wherein the processing liquid having fixing ability is used as the electrolyte solution in the concentration chambers and the anode chamber.

9. The method for processing of a photographic material according to claim 7, wherein electrodialysis treatment is carried out, while circulating constantly said stabilizing solution between the desalintion chambers and the cathode chamber in the electrodialytic cell.

10. The method for processing of a photographic material, according to claim 1, wherein the stabilizing solution contains an anti-fungal agent.

11. The method for processing of a photographic material according to claim 1, wherein the stabilizing solution contains an ammonia compound.

12. The method for processing of a photographic material according to claim 1, wherein the stabilizing solution has a pH value of 2 to 9.

13. The method for processing of a photographic material according to claim 1, wherein the replenishing amount of the stabilizing solution is not more than 2 liters per 1 $m^2$ of photographic material.

14. The method for processing of a photographic material according to claim 13, wherein the replenishing amount of the stabilizing solution is 20 ml to 1 liter per 1 $m^2$ of photographic material.

15. The method for processing of a photographic material according to claim 6, wherein the cathode chamber and a concentration chamber are partitioned off by an anion exchange membrane.

16. The method for processing of a photographic material according to claim 6, wherein the anode chamber and a desalination chamber are partitioned off by an anion exchange membrane.

17. The method for processing of a photographic material according to claim 6, wherein the electrodialytic cell consists of an odd number of cation exchange membranes and an even number of anion exchange membrane.

18. The method for processing of a photographic material according to claim 3, wherein the stabilizing solution contains a chelating agent selected from the group consisting of ethylenediamine diorthohydroxyphenylacetic acid, nitrilotracetic acid, hydroxyethylenediaminetriacetic acid, diethylenetriaminepentaacetic acid, hydroxyethyliminodiacetic acid, diaminopropanoltetraacetic acid, transcyclohexanediaminetraacetic acid, ethylenediaminetetrakismethylenephosphonic acid, nitriletrimethylenephosphonic acid, 1-hydroxyethylidene-1,1-diphosphonic acid, 1,1''-diphosphonoethane-2-carboxylic acid, 2-phosphonobutane-1,2,4-tricarboxylic acid, 1-hydroxy-1-phosphonopropane-1, 2,3-tricarboxylic acid, catechol-3,5-disulfonic acid, sodium pyrophosphate, sodium tetrapolyphosphate and sodium hexametapohsphate.

19. The method for processing of a photographic material according to claim 4, wherein the stabilizing solution contains as chelating agent 1-hydroxyethlidene-1,1-diphosphonic acid or salts thereof.

20. The method for processing of a photographic material according to claim 2, wherein the stabilizing solution contains an anti-fungal agent and ammonia.

* * * * *